United States Patent [19]

Geist et al.

[11] 3,958,589

[45] May 25, 1976

[54] SIPHON

[76] Inventors: John J. Geist; Joseph Giba, both of c/o George Spector, 3615 Woolworth Bldg., 233 Broadway, New York, N.Y. 10007

[22] Filed: July 16, 1974

[21] Appl. No.: 488,913

[52] U.S. Cl. ..... 137/149; 92/250

[51] Int. Cl.[2] ..... F04F 10/00

[58] Field of Search ..... 92/247, 250, 205; 137/149, 153

[56] References Cited

UNITED STATES PATENTS

| | | | |
|---|---|---|---|
| 45,989 | 1/1865 | Fuller | 92/250 X |
| 135,935 | 2/1873 | Paynter | 137/149 |
| 194,532 | 8/1877 | Potter | 92/205 |
| 194,640 | 8/1877 | Barker | 92/205 X |
| 616,731 | 12/1898 | Riemann | 137/149 |
| 1,031,007 | 7/1912 | Johnson | 137/149 |
| 1,544,938 | 7/1925 | Sax | 92/205 |
| 1,804,270 | 5/1931 | Palich | 137/149 |
| 2,687,845 | 8/1954 | Young et al. | 92/250 |
| 2,958,445 | 11/1960 | Jesse | 92/250 X |

FOREIGN PATENTS OR APPLICATIONS

| | | | |
|---|---|---|---|
| 218,313 | 6/1958 | Australia | 137/149 |
| 612,061 | 11/1969 | Italy | 137/149 |
| 332,796 | 7/1930 | United Kingdom | 137/149 |

*Primary Examiner*—Alan Cohan
*Assistant Examiner*—Gerald A. Michalsky

[57] ABSTRACT

A simply constructed and inexpensive syphon for rapidly lifting liquid out of a container, the syphon consisting of a flexible plastic tube in which there is a spongy plastic piston attached to a flexible cord which extends out of one end of the tube so it can be manually pulled whereby liquid is pulled into the tube behind it.

1 Claim, 6 Drawing Figures

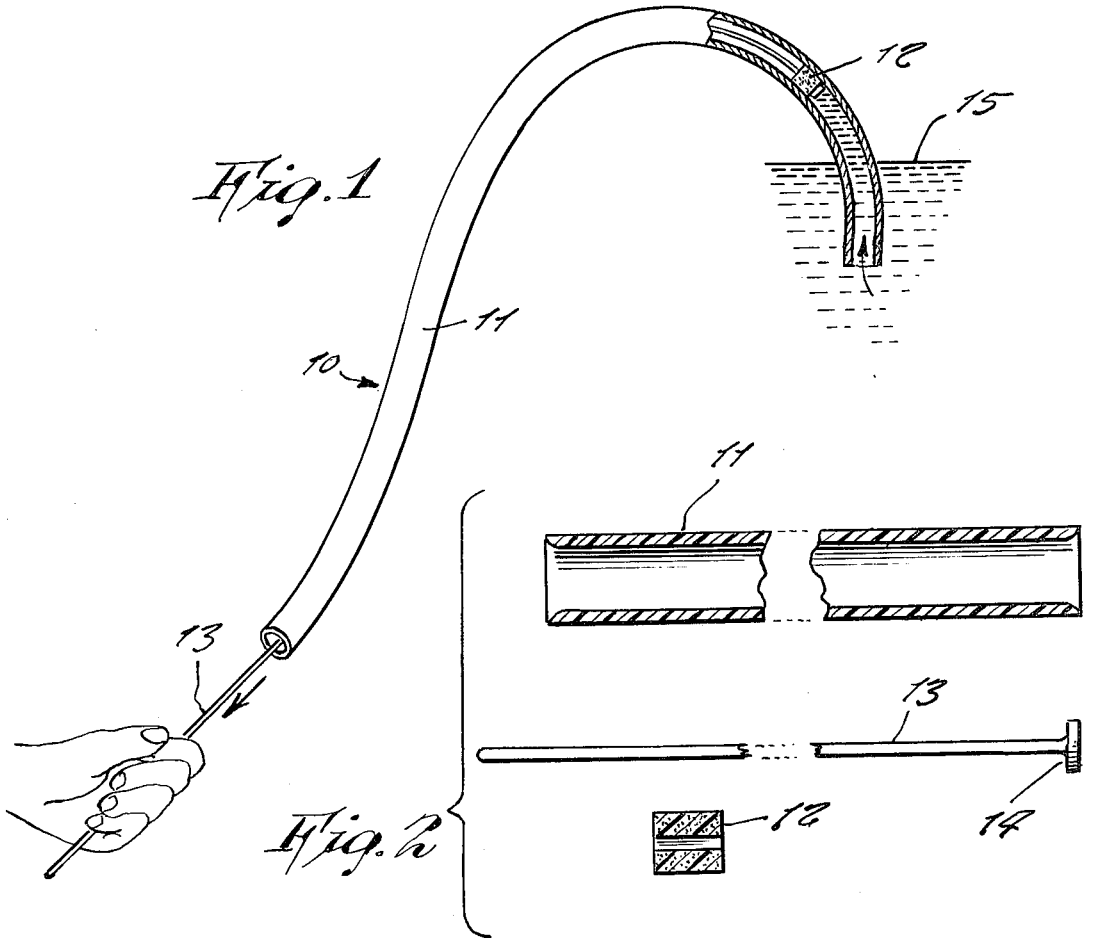
Fig. 1
12
15
11
10
13
Fig. 2
11
13
12
14
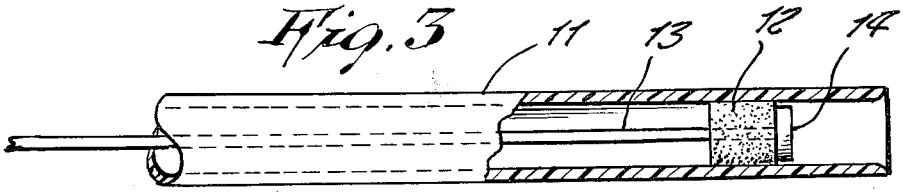
Fig. 3
11
13
12
14
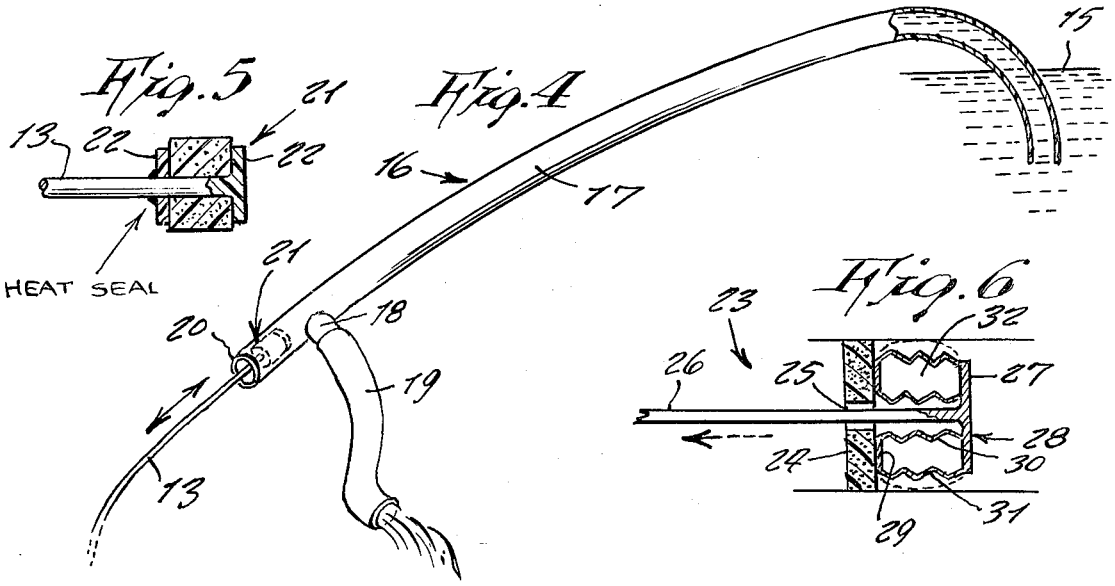
Fig. 5
21
13
22
22
HEAT SEAL
Fig. 4
15
16
17
21
20
18
19
13
Fig. 6
23
32
26
25
27
28
24
30
29
31

SIPHON

This invention relates generally to siphoning devices.

A principle object of the present invention is to provide a siphon for transferring liquids and which does not have any bulb to squeeze nor any valves that are subject to fail in operation.

Another object is to provide a syphon that is non-directional in construction so that either end of a flow tube can be immersed in a liquid that is intended to be pumped.

Still another object is to provide a syphon having a high flow rate.

Other objects are to provide a syphon that is simple in design, inexpensive to manufacture, rugged in construction, easy to use and efficient in operation.

These and other objects will be readily evident upon a study of the following specification and the accompanying drawing wherein:

FIG. 1 is a side view of the invention shown in use.

FIG. 2 is a side view partly in cross section of the components thereof.

FIG. 3 is an enlarged cross section showing the parts assembled.

FIG. 4 is a modified design of the invention that includes a side opening near one end, and which forms a discharge opening so to allow the piston remain inside the end of the tube, so that the piston can be pushed back in past the side hole so to close off the flow, thus forming a simple valve so to not break the liquid column in the tube while a receptacle that catches the liquid is being emptied.

FIG. 5 is a cross section of the piston of FIG. 4.

FIG. 6 is another modified design of piston in which it automatically increases to precisely fit the tube while the piston cord is being pulled.

Referring now to the drawing in detail, and more particularly to FIGS. 1 through 3 thereof, at this time, the reference numeral 10 represents a syphon according to the present invention wherein there is a ½ inch I.D. flexible plastic tube 11 of any desired length, and which receives therewithin a spongy plastic piston 12 of the same size; the piston having a ⅛ inch bore therthrough so a high tensile strength, flexible plastic cord 13 of a same size is received therethrough. One end of the cord 13 is molded to a ⅜ inch diameter disc 14 for bearing against one side of the piston as shown in FIG. 3.

In operative use, one end of the tube is inserted into a liquid 15, and the piston is positioned within the same end of the tube, with the cord extending out the tube other end. By pulling the cord, the piston slides inside the tube causing the liquid to be pulled upward behind it. When the piston is fully pulled out of the tube, the syphoned liquid now flows freely.

The tube can be made transparent if wished so the flow can be seen. The dimensions indicated above are only for one specific size, and may be either larger or smaller. The syphon can comprise an emergency equipment for carrying in a car, in case the car runs out of gas on a road, and gasoline can be supplied from an assisting vehicle gasoline tank.

In FIGS. 4 and 5, a modified design of the invention comprises a syphon 16 in which the tube 17 connects with a nipple 18 on a side near its outlet end, the nipple being connected to a sideward flexible tube 19. In this form of the invention, the piston need not necessarily be pulled completely out of the end 20 of the tube 17 but can remain inside the end 20 as shown in FIG. 4, while the liquid flows out of the side tube 19. When it is desired to stop the flow so a receiving vessel can be emptied, all that is needed to be done is to push the piston back inwardly in the tube 17 so to close flow to the nipple. Thus the liquid column within the tube 17 is not broken, and when further syphoning is intended to proceed, the piston is again moved into the position shown in FIG. 4 so that flow resumes.

The piston 21 of FIG. 4 is shown in FIG. 5 to include a plastic disc 22 on each side of the spongy piston member 12 connected to the cord so that it can be pushed by the cord 13 as well as be pulled thereby.

In FIG. 6, a modified design of piston 23 consists of disc 24 having central hole 25 through which a cord 26 is slidable and which is attached to a circular wall 27 of a cylindrical hollow member 28 having an end wall 29 attached to the disc 24. An accordian inner wall 30 and an accordian outer wall 31 connect between end walls 27 and 29. The interior 32 of the member 28 is filled with sealed air. When the cord 26 is pulled, the diameter of the member 28 expands due to the accordian construction so to precisely fit inside the tube and form a perfectly fitting piston.

Thus different forms of the invention are shown.

While various changes may be made in the detail construction, it is understood that such changes will be within the spirit and scope of the present invention as is defined by the appended claims.

What is claimed is:

1. A siphon comprising a flexible tube of generally uniform diameter having an open inlet and an open outlet end in combination with a generally cylindrical resilient piston mounted snugly within said tube, said piston being axially compressible and radially expandable wherein axial compression causes radial expansion, including a cord mounted through the axial center of the piston attached to a disc bearing against the end of the piston facing the tube inlet, said disc being of smaller diameter than said piston and formed of material relatively rigid compared to the piston whereby axial pressure of said disc against said piston causes radial expansion to sealingly conform to the tube internal surface, further including a lateral outlet nipple provided adjacent but spaced from the outlet end, wherein said piston is smaller in length than the tube length between the nipple and the outlet end and there is provided a second relatively rigid disc abutting the piston on the end facing the outlet end of the tube, wherein the piston is formed of an air filled accordian diaphragm and wherein the second said disc is of a diameter larger than the first said disc and generally equal to the internal diameter of the tube.

* * * * *